United States Patent [19]

Sievert et al.

[11] 4,171,392

[45] Oct. 16, 1979

[54] PROCESS OF PRODUCING ONE-SIDE ALLOYED GALVANIZED STEEL STRIP

[75] Inventors: William C. Sievert, Chesterton; James B. Cundiff, La Porte; Peter A. Klobuchar, Munster; Larry H. Lindberg, Valparaiso; James A. Kargol, Notre Dame, all of Ind.

[73] Assignee: Inland Steel Company, Chicago, Ill.

[21] Appl. No.: 958,800

[22] Filed: Nov. 8, 1978

[51] Int. Cl.[2] ..... C23C 1/02

[52] U.S. Cl. ..... 427/321; 427/349; 427/383 D; 427/433; 428/659

[58] Field of Search ..... 427/383 D, 349, 321, 427/433, 357, 225, 209, 376 H

[56] References Cited

U.S. PATENT DOCUMENTS

| | | | |
|---|---|---|---|
| 3,112,213 | 11/1963 | Lusa | 427/209 |
| 3,177,088 | 4/1965 | Sievert | 427/399 |
| 4,059,711 | 11/1977 | Mino et al. | 427/383 D |
| 4,104,088 | 8/1978 | Batz | 427/383 D |
| 4,120,997 | 10/1978 | Franks et al. | 427/376 H |

*Primary Examiner*—Ralph S. Kendall

*Attorney, Agent, or Firm*—Merriam, Marshall & Bicknell

[57] ABSTRACT

A process of consistently producing in an economical manner a galvanized steel strip having on one side a thin uniform surface coating of zinc-iron intermetallic compounds containing at least 6 percent iron and being free of metallic zinc and having on the other side a formable metallic zinc surface coating which is formed by continuously immersing the steel strip in a hot-dip zinc coating bath in which the temperature of the steel strip and the coating bath are controlled within a limited range to avoid forming an exclusively thick zinc iron intermetallic layer during hot-dip coating which interferes with good formability of the metallic zinc surface coating and controlling the thickness and uniformity of the zinc coating which is transformed into the coating formed of zinc-iron intermetallic compounds within a range of 10 to 30 $g/m^2$ while maintaining the variation in coating weight within a range of from 3 to 6 $g/m^2$ and heating the strip rapidly to a peak temperature of between about 482° C. and 524° C. within a period of 3 to 5 seconds and allowing the strip to cool below the melting point of the zinc coating.

5 Claims, No Drawings

PROCESS OF PRODUCING ONE-SIDE ALLOYED GALVANIZED STEEL STRIP

The present invention relates generally to a method of zinc coating a ferrous metal, and more particularly to a method of providing a zinc-iron intermetallic surface coating on only one side of a hot-dip galvanized ferrous metal strip having a hot-dip metallic zinc surface coating on the other side.

Galvanized steel sheet material is widely used where the steel sheet material is exposed to a corrosive atmosphere or other corrosive environment. One important use for corrosion resistant steel sheet material is in the manufacture of automobile bodies where one surface of the steel sheet material is generally painted or welded and the other side exposed to a highly corrosive environment. Since a metallic zinc surface coating has poor paintability even after being further chemically treated, it has been found desirable to convert one surface of a hot-dip coated steel strip into a surface which is free of metallic zinc and can be painted. For example, processes have been devised for removing the zinc from one surface of a hot-dip coated zinc sheet in order to provide a metallic iron surface which is paintable and weldable. It also has been previously found that when a zinc surface coating is converted into a surface coating formed of zinc-iron intermetallic alloy, the alloy coating is weldable and readily paintable (see Lusa U.S. Pat. No. 3,177,053).

Attempts to produce continuously a corrosion resistant differentially coated hot-dip galvanized steel strip having a continuous zinc-iron intermetallic coating on only one side by the prior art processes have failed to provide consistently a product which has the required uniformity, ductility and adherence properties required of steel sheet material used in the automobile industry. Thus, where attempts are made to form a uniform zinc-iron coating on the light weight zinc coated side of a differentially hot-dip coated galvanized steel strip, the lighter weight zinc coating on the steel strip is frequently found to be alloyed in the center of the strip but is over heated on the remaining portions with the resulting reflowing of the coating instead of alloying. Also, the heavier zinc coating on the opposite side of the strip is frequently found to have randomly dispersed islands of intermetallic zinc-iron alloy extending entirely through zinc coating, and an excessively heavy zinc-iron intermetallic alloy subsurface layer having poor formability and adherence is often formed between the steel base and the heavier zinc surface coating.

It is therefore an object of the present invention to provide an improved process for consistently producing in a more economical manner a steel strip material having a formable hot-dip galvanized coating on one surface and having on the other surface a uniform zinc-iron intermetallic surface coating which exhibits good weldability and after chemical treatment exhibits superior paintability.

It is also an object of the present invention to provide an improved zinc coated ferrous metal strip having a formable corrosion resistant metallic zinc coating on one surface and having on the other surface a uniform zinc-iron intermetallic coating which exhibits good paintability and weldability properties.

Other objects of the present invention will be evident to those skilled in the galvanizing art from the detailed description and claims to follow.

In order to achieve the foregoing objects of the present invention and produce consistently on a continuous heat treat in-line type hot-dip coating line a uniform zinc-iron intermetallic coating free of metallic zinc on one surface of a steel strip while retaining an adherent formable protective metallic zinc coating on the other surface of the steel strip, it has been found necessary to carefully control several variables in the process which heretofore were not considered critical and to maintain the operating parameters within critical ranges much narrower than heretofore thought necessary for the production of commercially acceptable hot-dip coated steel strips having an zinc-iron intermetallic surface coating on one side only. More particularly, in order to produce in an economical manner a commercially acceptable coated hot-dip alloyed steel strip of the foregoing type it has been found necessary to provide on at least one lateral surface of the steel strip an extremely thin light weight hot-dip zinc coating having a substantially uniform coating weight throughout the length and width thereof so that when the critical operating conditions are established, such as coating bath temperature and alloying furnace temperatures which cannot be rapidly varied and which are just sufficient to completely convert all the zinc in the light weight coating into a surface coating comprised mainly of zinc-iron intermetallic compound without forming an objectionally thick subsurface alloy layer on the opposite side of the strip, there will not be areas in the light weight coating which are so thick that they will not be converted into zinc-iron intermetallic compounds or be so thin that they will be overheated. It has been found that the light weight coating should be as light as possible but in no event have a coating weight in excess of about 30 g/m$^2$ (0.10 oz/ft$^2$). And, it is particularly critical that the coating weight should not vary more than about 3 to 6 g/m$^2$ across the width of the strip. With present day coating weight control means the weight of the light weight hot-dip coatings can be maintained between about 10 g/m$^2$ and 30 g/m$^2$ (0.06 to 0.10 oz/ft$^2$) which is equivalent to a thickness of 2.4 $\mu$m and 4.3 $\mu$m. The hot-dip zinc coating on the opposite side of the strip can be of any weight desired, but generally will have a uniform coating weight between about 105 g/m$^2$ and 165 g/m$^2$ (0.35 oz/ft.$^2$ and 0.55 oz/ft.$^2$).

To facilitate maintaining the light weight zinc coating within the required parameters the steel strip to be hot-dip coated should have a substantially uniform composition and uniform gauge which can range between about 0.38 mm and 1.52 mm (0.015 and 0.06 inches) and which generally ranges between about 0.65 mm and 1.14 mm (0.025 and 0.045 inches) in thickness with only minor variations in thickness across the width of the strip. The steel strip should also have a uniform surface finish on the side thereof provided with the light weight zinc coating.

When employing a continuous heat treat in-line type hot-dip coating line to provide the required differential hot-dip coating, the surface of the steel strip is first cleaned and then rapidly heated to the required peak metal temperature, generally between about 538° C. and 927° C. (1000° F. and 1700° F.), in a reducing atmosphere to provide a clean, oxide free metallic surface suitable for hot-dip galvanizing and to impart the desired metallurgical properties to the steel strip. The steel strip must then be cooled to a temperature about 50° F. above the operating temperature of the zinc hot-dip coating bath while in a reducing atmosphere before the strip is immersed in the coating bath in order to avoid formation of an excessively thick zinc-iron intermetallic layer while the strip remains in the hot-dip coating bath. While it would be more economical to transform all of the zinc on the light weight hot-dip coating side into the zinc-iron intermetallic compounds while the strip is immersed in the molten zinc hot-dip coating bath and thereby eliminate the necessity of heating the coating in an alloying furnace, the temperature conditions in the bath required to form directly such a zinc-iron intermetallic coating on the light weight side would also form a coating of zinc-iron intermetallic layer of similar thickness on the heavier zinc coated side of the strip which would seriously impair the coating adherence and formability. It has been found that when the thickness of the subsurface zinc-iron intermetallic layer on the heavier coating side either exceeds a thickness of about 5 μm or forms more than 10 percent of the thickness of a zinc hot-dip coating on the heavier coated side of the strip, the heavier zinc coating has poor adherence and formability.

The temperature of a steel strip which preferably has a uniform thickness between about 0.65 mm and 1.14 mm (0.025 and 0.045 inches) when immersed in the coating bath is maintained at a temperature below 510° C. (950° F.) and preferably between about 493° C.–510° C. (920° F.–950° F.), as measured at the turn down roll at the entrance to the hot-dip zinc coating bath, in order to prevent an excessively heavy alloy layer forming in the heavy coating side of the strip while the strip is in the hot-dip coating line. The required close temperature control of the strip entering the molten zinc hot-dip coating bath in a heat treat in-line type continuous hot-dip coating line is achieved by manipulation of the jet cooling section of the coating line which is disposed before the turn down roll and which is adapted to compensate for any strip temperature difference due to a variation in the gauge of the strip.

The temperature of the molten zinc coating bath must also be carefully controlled to avoid an excessively high temperature and temperature variations which could cause excess alloy layer formation in the bath on the heavier zinc coated side and is preferably controlled within the range of 477° C–482° C. (890° F.–900° F.) with the residence time of the steel strip in the bath preferably being between about 3–5 seconds.

The composition of the zinc hot-dip coating bath should also be kept reasonably constant, particularly with regards to the aluminum content, since aluminum has a well known retarding affect on the rate of zinc-iron intermetallic alloy formation during hot-dip galvanizing. It has long been standard practice to add aluminum to the galvanizing bath at a concentration between about 0.13 and 0.20 weight percent to prevent excess intermetallic alloy formation in the coating bath. In the present process it is preferred to maintain the aluminum content at a uniform level of between about 0.14–0.16 weight percent.

As the strip is withdrawn from the zinc coating bath, the molten zinc coatings on both lateral surfaces of the strip are subjected to coating weight control means which control thickness or weight of the hot-dip coatings by removing molten zinc in excess of the desired coating weight. The coating weight control means preferably used in the present process for providing the light weight coating on one side of the steel strip comprises jets of gas, such as high velocity steam, nitrogen or air, which impinge on the molten zinc coating and provide the desired coating weight. Similar jets of gas having a reduced velocity can be used to provide a uniform coating weight on the heavier coating side of the strip. The jets of gas generally have a temperature below the temperature of the strip leaving the hot-dip coating bath (which is about 482° C. or 900° F.), and the strip is cooled by the gas jets to a temperature of about 427° C. (800° F.). An example of suitable apparatus for controlling the coating weight is found in the Bozeman and Blackwell U.S. Pat. No. 3,667,425.

In order to complete the transformation of the metallic zinc remaining in the light weight coating side of the strip into a coating comprised mainly of zinc-iron intermetallic compounds without causing an objectionable increase in the thickness of the subsurface zinc-iron intermetallic layer on the opposite side of the strip, the strip is continuously rapidly heated to a peak strip temperature in a heating zone, such as a gas fired or radiant heated furnace chamber, which applies a controlled amount of heat directly to only the light weight coating side of the strip, preferably while the light weight coating is still molten, and thereafter allowing the strip to cool. If the rate of heating and resulting peak temperature to which the strip is heated is not sufficiently high during the continuous passage of the strip through the furnace chamber, the light weight coating will not be completely converted into the desired zinc-iron intermetallic compounds having a dull matte grey surface appearance but will have random bright areas of free zinc. The same poor, non-uniform surface is formed if the rate of heating and resulting peak strip temperature is too high, apparently due to the decomposition of the zinc-iron intermetallic compounds at temperatures in excess of about 593° C. (1100° F.). Thus, in addition to providing a uniform light weight zinc coating on one side of the hot-dip coated steel strip, it is necessary to heat the strip in the furnace chamber at a rapid rate from a temperature just above the melting point of the zinc coating to within a critical minimum and maximum peak temperature and then allow the strip to cool in order to consistently produce a uniform zinc-iron intermetallic surface coating on one side which is free of metallic zinc and a metallic zinc surface on the opposite side of the strip which is free of objectionable surface alloying and which does not have a subsurface zinc-iron intermetallic layer of such thickness that it causes poor adherence and formability of the heavier metallic zinc coating.

In one form the heating zone comprises a furnace chamber in the form of an open box-like structure with a bank of gas burner nozzles mounted on the inner surface of the vertical wall facing the light weight coated side of the strip. The gas burners are adapted to heat the light weight coating to a peak temperature which results in rapidly transforming all of the zinc remaining in the light weight coating into an exceptionally smooth and uniform zinc-iron intermetallic coating which contains at least 6% iron and which is formed of the compound $FeZn_7$ (Delta phase containing about 7 to 11 weight percent iron) along with the compound $FeZn_{13}$ (Zeta phase containing about 6% iron) and other zinc-iron compounds with only a very minor proportion of zinc-iron diffusion alloy having no specific formula and without causing an objectionable increase in the amount of subsurface iron-zinc intermetallic compounds formed on the opposite side of the strip beneath the heavier metallic zinc surface coating.

When hot-dip galvanizing a steel strip in the above described manner, the strip on entering the furnace chamber will have a temperature of about 427° C. (800° F.) and should be rapidly heated in the furnace chamber to a temperature between about 482° C.–524° C. (900° F.–975° F.) as measured at the exit end of the furnace by an Ircon radiation temperature measuring device cited on the heavy weight zinc coated surface. The residence time of the strip in the furnace chamber required to heat the strip to the above specified peak temperature can be between about 3 to 5 seconds. The residence time can be determined by controlling the line speed of the strip with the maximum line speed being limited by the heating capacity of the furnace. The typical commercial continuous hot-dip zinc coating line will generally be operated at a line speed between about 0.75 m/sec. and 1.5 m/sec. (150 ft/minute and 300 ft. per minute). As the line speed is increased the dwell time of the strip in the furnace is reduced and the rate of heating the strip in the furnace chamber must be increased proportionately in order to effect complete transformation of all the zinc in the light weight coating into the desired zinc-iron intermetallic coating.

As a guide for determining the required rate of heating in the furnace or the dwell time of the strip in the furnace which are equivalent to those specified herein for transforming the metallic zinc remaining in a light weight zinc coating into the desired zinc-iron intermetallic coating without causing an objectionable increase in the thickness of the zinc-iron intermetallic layer on the opposite side of the strip where the strip has a known temperature when entering the furnace chamber, a known thickness of the light weight zinc hot-dip coating and a subsurface zinc-iron intermetallic layer on the light weight coating side prior to entering the furnace chamber of known thickness, the following equation is provided:

$$X=2\{D(T_1)t_s\}^{\frac{1}{2}}\{1+4\cdot10^{-3}(dT/dt)t_s+14\cdot10^{-6}(dT/dt)t_s^2\}$$

wherein:

X = thickness of the light weight zinc coating to be converted into the zinc-iron intermetallic coating $2\{D(T_1)t_s\}^{\frac{1}{2}}$ = thickness of the subsurface intermetallic layer prior to entry into the furnace chamber.

$D(T_1)$ = zinc-iron diffusion rate in $\mu m^2$/sec.

$t_s$ = strip dwell time in seconds.

$dT/dt$ = heating rate in °C./second.

The foregoing equation can be used to determine the rate of heating required in the furnace chamber to provide the one-side-only zinc-iron intermetallic surface coating when a change in the line speed or change in the coating weight are made while the other operating conditions are constant. For example, where the light weight zinc coating has a coating thickness of 3.8 μm and a subsurface zinc-iron intermetallic layer thickness of 2.8 μm with a strip temperature of about 427° C. (800° F.) when entering the furnace chamber, the heating rate required to transform all the remaining zinc in the light weight coating into a zinc-iron intermetallic surface coating when the line speed is 1.35 m/sec (210 ft/minute) which is equivalent to a strip dwell time in the furnace of 3.1 seconds will be:

$$3.8\ \mu m=2.8\ \mu m\{1+(4\cdot10^{-3}\cdot dT/dt\cdot3.1\ sec.)+(14\cdot10^{-6}\cdot dT/dt\cdot3.1^2\ sec.)\}$$

$$1.0\ \mu m=(3.4\cdot10^{-2}\ \mu m\cdot dT/dt+(4\cdot10^{-4}\ \mu m\cdot dT/dt)$$

$$1.0\ \mu m=3.44\cdot10^{-2}\mu m\cdot dT/dt$$

$$29°\ C./sec.=dT/dt$$

If the light weight coating thickness is reduced to 3.3 μm while all other operating conditions remain unchanged, the rate of heating required in the furnace to form the zinc-iron intermetallic surface coating can be readily determined by using the foregoing equation as follows:

$$3.3\ \mu m=2.8\ \mu m\{1+(4\cdot10^{-3}\cdot dT/dt\cdot3.1\ sec.)+(14\cdot10^{-6}\cdot dT/dt\cdot3.1^2\ sec.)\}$$

$$0.5\ \mu m=(3.4\cdot10^{-2}\ \mu m\cdot dT/dt+(4\cdot10^{-4}\ \mu m\cdot dT/dt$$

$$0.5\ \mu m=3.44\cdot10^{-2}\mu m\cdot dT/dt$$

$$14.5°\ C./sec.=dT/dt$$

If the heating furnace has a maximum heating rate of 22° C. per second, the foregoing equation can be used to determine the dwell time $t_s$ or line speed where the other operating conditions are unchanged as follows:

$$3.8\ \mu m=2.8\ \mu m\{1+4.10^{-3}\cdot22°\ C./sec.\cdot t_s\ sec.)+(14\cdot10^{-6}\cdot22°\ C./sec.\cdot t_s\ sec.)\}$$

$$3.8\ \mu m=2.8\ \mu m+(2.5\cdot10^{-1}\ \mu m\cdot t_s\ sec.)+(9\cdot10^{-4}\ \mu m\cdot t_s^2\ sec.)$$

$$1.0\ \mu m=0.25\ \mu m\cdot t_s\ sec.$$

$$4.0=t_s\ sec.$$

Thus, for a furnace having a length of 4.3 m (14 ft.) the line speed must be 1.05 m/sec. or 210 ft./minute.

To further illustrate the process of the present invention a low carbon cold rolled galvanizing steel strip having a thickness of about 0.89 mm (0.035 inches) is moved continuously through a Sendzimir-type continuous hot-dip coating line at a speed of about 1.42 m/sec. (240 feet per minute). The strip has a temperature of 493° C.–510° C. (920° F.–950° F.) at the turn-down roll at the inlet end of the coating bath and enters the hot-dip zinc coating bath which has a temperature between about 477° C.–482° C. (890° F.–900° F.). The coating bath has the following composition: 0.14–0.15 wt. % aluminum, 0.03 wt. % iron, 0.08 wt. % lead, and 0.023 wt. % antimony with the balance essentially zinc. The strip passes through the coating bath having a temperature about 477° C.–482° C. (890° F.–900° F.), around the sinker roll and vertically upwardly out of pot between oppositely disposed gas jet-type coating weight control nozzles with each of the nozzles individually adjusted to blow jets of steam at a temperature of about 177° C. (350° F.) onto the opposite surfaces of the strip. The nozzles are adjusted to provide on the side of the strip to be transformed into a zinc-iron intermetallic coating a uniform light weight coating of zinc having a coating weight of 27 g/m² (0.09 oz. per square foot) or a coating thickness of 0.00009 inches) with a variation in the coating weight of no more than a 3 to 6 g/m². The opposite side of the strip is provided with a heavier zinc coating having a weight of about 135 g/m² (0.45 oz. per square foot) equal to a coating thickness of about 17.8–20.3 μm (0.0007–0.0008 inches). The strip having a temperature of about 427° C. (800° F.) moves vertically upwardly into a furnace chamber while the zinc coatings are still in a molten condition. The furnace chamber is provided with a plurality of gas burner jets on the inner lateral wall facing the light weight zinc coating which are adapted to impinge on the light weight coating having a thickness of 3.8 μm (0.09 oz/ft$^2$) and a zinc-iron intermetallic layer of 2.8 μm in thickness and heat the strip in the chamber within a period of about 3.5 seconds (i.e. strip dwell time in the furnace) to a peak temperature between about 482° C. and 510° C. (900° and 950° F.), as measured at the exit end of the chamber by an Ircon temperature measuring device. When the strip is heated to the aim temperature of 496° C. (925° F.), the rate of heating in the furnace is 26° C./sec. The opposite inner wall of the furnace chamber is optionally provided with a plurality of air jets adapted to blow ambient air at a temperature of about 16° C. (60° F.) onto the heavier zinc coated surface in the area directly opposite the surface of the strip being heated by the gas jets. The cooling jets are adapted to blow ambient air onto the heavier coated side of the strip at a rate of about 1.42 m$^3$/sec. to 1.89 m$^3$/sec. (3,000 to 4,000 cubic feet per minute) so as to rapidly withdraw heat from the strip to insure that the temperature of the heavier zinc coating remains below a temperature at which an objectionable amount of subsurface zinc-iron intermetallic compound is formed and the heavier zinc coating has a smooth uniform surface. Immediately after reaching the peak temperature the steel strip leaves the furnace chamber, and the strip is air cooled below the melting point of the hot-dip coating as it passes over the exit roll onto a coiler. The steel strip which can be any low carbon steel, such as rimmed steel, aluminum killed steel or a semi-killed steel, with or without small amounts of alloying elements, can be further treated to provide the metallurgical properties required by the purchaser without affecting the coatings.

When reference is made in the specification and claims to "zinc coating", "zinc coating bath" or "galvanizing" or "galvanizing bath", it should be understood that the term "zinc" and "galvanizing" is intended to include any conventional metallic zinc spelter and the term "zinc coating bath" or "galvanizing bath" includes any zinc based bath compositions, including zinc alloy hot-dip coating baths containing one or more metals, such as aluminum, lead, antimony, magnesium or other metal which can be used in a zinc based protective coating bath or a zinc based hot-dip coating bath to impart special properties to the bath or coating.

We claim:

1. A continuous process for consistently producing a hot-dip galvanized ferrous metal strip having a paintable zinc-iron intermetallic coating on one lateral surface and an adherent formable coating of metallic zinc on the opposite lateral surface comprising; continuously passing an endless strip of galvanizing steel having a substantially uniform thickness at a controlled line speed along a heat treat in-line continuous hot-dip galvanizing line which provides a clean metallic surface free of oxides and contaminates which is adapted for coating in a hot-dip galvanizing bath, controlling the temperature of the strip at a temperature about 50° F. above the hot-dip galvanizing bath temperature measured at the turn-down ball prior to immersing the strip in the hot-dip galvanizing bath having an aluminum coating of between about 0.13 and 0.20 wt. % aluminum, maintaining the zinc hot-dip coating bath at a temperature between about 477° C.–482° C. (890° F. and 900° F.) while the strip remains in the bath for a period of between about 3 and 5 seconds, passing the strip from the hot-dip galvanizing bath between coating weight control means comprising gas jets which remove molten zinc from the surface of the strip to provide on one side a uniform light weight zinc hot-dip coating having a maximum weight of 30 g/m$^2$ which does not vary in weight more than 3 to 6 g/m$^2$ and a uniform heavier weight zinc coating on the opposite side of the strip, passing said strip while the light weight coating is still molten through a heating zone which heats the strip from a temperature of about 427° C. (800° F.) to a peak temperature between about 482° C.–524° C. (900° F.–975° F.) within a period of about 3 to 5 seconds to transform all of the zinc remaining in the light weight coating into a uniform zinc-iron intermetallic surface coating which is free of metallic zinc and which contains at least 6 wt. % iron without forming a subsurface zinc-iron intermetallic layer on the opposite side of the strip having a thickness which impairs the formability of the zinc coating on the other side of the strip and immediately thereafter allowing said strip to cool from said peak temperature to below the melting point of said zinc coatings.

2. A process as in claim 1, wherein said light weight coating has a coating weight between about 10 and 30 g/m$^2$.

3. A process as in claim 1, wherein said heavier weight zinc coating has a coating weight between about 105 g/m$^2$ and 165 g/m$^2$ (0.35 and 0.55 oz/ft$^2$).

4. A continuous process as in claim 1, wherein said heating zone is comprised of a furnace chamber having a plurality of gas burner jets adapted to impinge on the light weight coating side of the said steel strip and heat said strip.

5. A continuous process as in claim 1, wherein said steel strip is heated in said heating zone to a said peak temperature between about 482° C. and 510° C. (900° F.–950° F.) in a period of about 3.5 seconds.

* * * * *